United States Patent [19]

Walden

[11] Patent Number: 4,651,353

[45] Date of Patent: Mar. 24, 1987

[54] DISPOSABLE PATIENT PANTS

[76] Inventor: Gwendolyn Walden, 823 Hussa St., Linden, N.J. 07036

[21] Appl. No.: 795,769

[22] Filed: Nov. 7, 1985

[51] Int. Cl.[4] ..... A41D 1/06

[52] U.S. Cl. ..... 2/227; 2/114; 2/DIG. 6

[58] Field of Search ..... 2/114, 227, 403, 238, 2/DIG. 7, DIG. 6

[56] References Cited

U.S. PATENT DOCUMENTS

| | | | |
|---|---|---|---|
| D. 29,162 | 8/1898 | Buren | D2/753 |
| D. 42,566 | 5/1912 | Salzenstein | D2/38 |
| D. 122,186 | 8/1940 | Ranuzzi . | |
| D. 257,697 | 12/1980 | Angrisano et al. . | |
| D. 274,670 | 7/1984 | Smith . | |
| 2,520,026 | 8/1950 | Beitchman | 2/227 |
| 3,359,569 | 12/1967 | Rotanz et al. | 2/114 |
| 3,800,330 | 4/1974 | Bowcut | 2/227 |
| 3,843,971 | 10/1974 | Delanty et al. | 2/114 |
| 3,855,635 | 12/1974 | Ramirez | 2/114 |
| 4,145,763 | 3/1979 | Abrams et al. | 2/DIG. 6 |
| 4,258,440 | 3/1981 | McGowan | 2/114 |
| 4,422,186 | 12/1983 | Loney | 2/114 |
| 4,434,511 | 3/1984 | Weiser | 2/114 |

FOREIGN PATENT DOCUMENTS

| | | | |
|---|---|---|---|
| 1374331 | of 0000 | France | 2/DIG. 6 |
| 2027330 | 2/1980 | United Kingdom | 2/DIG. 6 |

*Primary Examiner*—Doris L. Troutman

*Attorney, Agent, or Firm*—R. Martin Oliveras

[57] ABSTRACT

A disposable patient pants comprises two front panels, two rear panels, a front elastic waist band joining the two front panels on top, and a rear elastic waist band joining the two rear panels on top, the four panels being joined at common seams emanating from the crotch area, each panel being made of sheet material and further comprising: a first straight edge running from the crotch area to the lower medial side of the leg; a second straight edge running from the medial side of the leg to the lower lateral side of the leg; a third straight edge including fastening means running from the lower lateral side of the leg to the upper lateral side of the waist including the lateral end of the waist band; a fourth straight edge running from the upper lateral side of the waist including the lateral end of the waist band to the center of the waist band; and a fifth straight edge running from the center of the waist band to the crotch area; wherein respective first straight edges are permanently joined to form the medial seams of the legs; respective fifth straight edges are permanently joined to form central seams of the pants; respective third straight edges including the fastening means are temporarily joined in an overlapping manner to form the lateral seams of the legs; respective fourth straight edges are permanently joined colinearly on either end of the elastic waist band to form the tops of the pants; respective unjoined front and rear second straight edges define the the bottom openings of the legs; and wherein respective unjoined front and rear fourth straight edges define the top openings of the pants.

3 Claims, 4 Drawing Figures

DISPOSABLE PATIENT PANTS

FIELD OF THE INVENTION

This invention relates to patient hospital gowns and in particular to disposable pants.

OTHER RELATED APPLICATIONS

This utility patent application is related to prior design patent application by the same applicant herein having Ser. No. 751,263, filing date 7/2/85, and being entitled "Disposable Patient Pants Design."

DISCUSSION OF THE PRIOR ART

The prior art reveals patient hospital attire or the like such as:

Rotanz et al U.S. Pat. No. 3,359,569 entitled "Surgical Gown" discloses a surgical gown comprising a main sheet and sleeves connected integrally thereto, a sheet of fluid repellant material, a closure, means to facilitate aseptic closing of the gown, and a folded belt. Specifically disclosed are sleeves 3, edges 6 and 7, front portion 13, flaps 4 and 5, back portion 14, bottom 15, main sheet 2, pockets 8, tab 12, steel clip 21, second portion 11, and neck band 9;

Delanty et al U.S. Pat. No. 3,843,971 entitled "System And Method For Obtaining Closure Of Sterile Backed Surgical Gowns" discloses a garment comprising a front panel, a back panel, a top neck opening, a bottom opening, and pressure sensitive means. Specifically disclosed are back opening 22, bottom opening 16, fold 18, folded flap 38, pressure sensitive adhesive tape 40, female member 26, folded panel 36, releasable cover 20, closure fastener members 24 and 28, opposing members 30, 32, and 34, adhesive tape 42,and top neck opening 12;

Ramirez U.S. Pat. No. 3,855,635 entitled "Two Piece Hospital Gown" discloses a hospital gown comprising a blouse section, a pants section formed from two similar rectangular sheets, and adhesive tape fastening means. Specifically disclosed are leg members 20, edge 26, edge 25, vertical edge 74, tab section 57, edge 64, and front section 53;

McGowan U.S. Pat. No. 4,258,440 entitled "Clothes For The Physically Handicapped" discloses a garment comprising a front panel, a rear panel, loops, a crotch portion, and fastening means. Specifically disclosed are panels 12 and 14, edge margins 24 and 22, cloth or fabric 11, loops 30, fastener 26, and conventional bias tape 20;

Loney U.S. Pat. No. 4,422,186 entitled "Hospital Garment" discloses a hospital garment comprising a gown, a front plurality of pieces of opposing mating fabric material, a first plurality of removable extension strips, a pants portion, a second plurality of pieces of opposing mating fabric material, and a second plurality of removable extension strips. Specifically disclosed are slit 673, piece 645, element 602, waistband 634, fly 632, and element 604;

Weiser U.S. Pat. No. 4,434,511 entitled "Hospital Gown" discloses a gown comprising a front panel portion, a back panel, a second front panel portion, and releasable fastening means. Specifically disclosed are second front panel 18, releasable fastening means 28, back panel 16, end edge 12, first front panel 14, relief 26, upper edge 30, tab 46, second shoulder portion 36, tie string 42, collar 40, opening 38, arm hole 22, and shoulder portion 24; and U.S. Pat. Nos. Des. 29,162; 42,566; 122,186; 257,697; and 274,670 also show several garments.

However, the above mentioned prior art patents do not disclose the Disposable Patient Pants as described and claimed by applicant.

Objects of the present invention are therefore to provide:

a patient pants which allows for and facilitates the dressing of the patient while still on his back;

a patient pants which is made of a unitary universal pattern or section and material and which is of the lateral pant leg closing type;

a patient pants which can be placed on the patient without having to lift the patient from the bed and which can be placed by one person;

a patient pants that may be inexpensively produced from sheets of cloth or paper material;

a patient pants that can be readily fastened about or removed from the patient especially a patient who may be physically disabled or handicapped; and a patient pants that allows for more frequent checks of the patient without having to fully disrobe the patient.

SUMMARY OF THE PRESENT INVENTION

A summary and features of the present invention are as follows:

a. a disposable patient pants made of fabric or paper comprises two front panels, two rear panels, a front elastic waist band joining the tops of the two front panels, and a rear elastic waist band Joining the tops of the two rear panels, the four panels being joined at four common seams emanating from the crotch area;

b. each panel is made of sheet material and further comprises: a first straight edge running from the crotch area to the lower medial side of the leg; a second straight edge running from the lower medial side of the leg to the lower lateral side of the leg; a third straight edge including releasable fastening means running from the lower lateral side of the leg to the upper lateral side of the waist including the lateral end of the elastic waist band; a fourth straight edge running from the upper lateral side of the waist including the lateral end of the elastic waist band to the center of the elastic waist band; and a fifth straight edge running from the center of the elastic waist band to the crotch area;

c. respective first straight edges are permanently joined to form the medial vertical seams of the legs;

d. respective fifth straight edges are permanently joined to form the central vertical seams of the pants;

e. respective third straight edges including the releasable fastenting means are temporarily joined in overlapping manner to form the lateral vertical seams of the legs;

f. respective fourth straight edges are permanently joined colinearly on either end of the elastic waist band to form the horizontal top edges of the pants;

g. respective unjoined front and rear second straight edges define the bottom openings of the legs;

h. respective unjoined front and rear fourth straight edges define the top opening of the pants;

i. the anterior and posterior central aspects of each leg include stylish vertical creases;

j. respective front fifth straight edges are only partially joined to define the top, anterior, central, vertical opening of the pants or the so called fly area;

k. the two joined front panels may include the releasable fastening means on the anterior aspect of the respective front third straight edges and the two joined rear panels may include the releasable fastening means on the posterior aspect of the respective rear third straight edges to allow for the temporary joining of same in the overlapping manner as aforesaid.

Advantages of the present invention are therefor that: it is disposable and does not have to be washed or recycled if same is not desired; it is easy and simple to manufacture, package, ship, and store; it provides for the privacy of the patient; it is applicable to different patient sizes be they male or female; it has an esthetic design and appeal; and the lateral edges of the legs may be opened temporarily to provide access to the patient's legs for examination.

DESCRIPTION OF THE DRAWING

The above and other objects, features, and advantages of the present invention will be better appreciated from a reading of the following detailed description in conjunction with the drawing in which.

DETAILED DESCRIPTION

Figure 1:
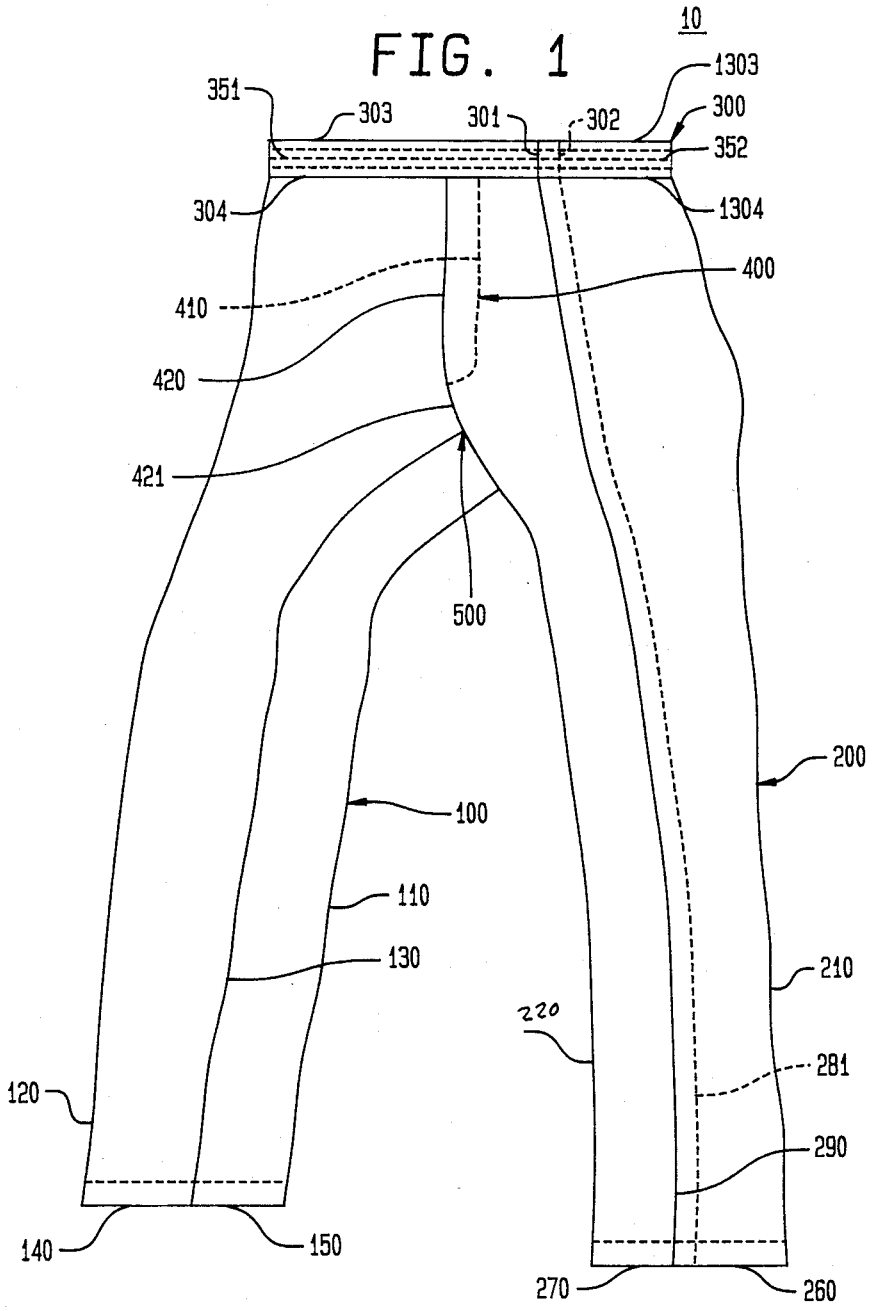
FIG. 1 is a left front oblique perspective view of the joined disposable patient pants of the present invention.

FIG. 1 is a left front oblique perspective view of Disposable Patient Pants 10 according to the present invention. Pants 10 comprises: right leg 100; left leg 200; elastic waist band 300; fly area 400; and crotch area 500. Right leg 100 further comprises: rear vertical crease 110; front vertical crease 120; medial vertical seam 130; front medial horizontal lower edge 140; and rear medial lower horizontal edge 150. Left leg 200 further comprises rear vertical crease 210; front vertical crease 220; rear lateral lower horizontal edge 260; front lateral lower horizontal edge 270; lateral vertical rear inner edge 281; and lateral front outer edge 290. Elastic waist band 300 further comprises front elastic waist band 351; rear elastic waist band 352; lateral vertical front outer edge 301 being a continuation of edge 290; lateral vertical inner rear edge 302 being a continuation of edge 281; upper front and rear horizontal edges 303 and 1303 respectively; and lower front and rear horizontal edges 304 and 1304 respectively. Fly area 400 further comprises: internal lateral vertical edge 410; external central vertical edge 420; and central vertical seam 421. Crotch area 500 is defined by the intersection of seam 130 and seam 421. External edges 290 and 301 face anteriorly and respectively overlap internal edges 281 and 302 which face rearwardly. The inner or internal surface associated with edge 290 and the outer or external surface associated with edge 281 overlap to the extent shown and include manually releasable and attachable fastening means such as Velcro fastening means. Fly area 400 may or may not further comprise a vertical zipper or may or may not further comprise vertical Velcro fastening means so long as the internal surface associated with edge 420 and the external surface associated with edge 410 provide or define a vertical opening especially for the convenience of the male patients. Elastic waist band 300 includes elastic means for accommodating the various sizes of the patients' waists.

Figure 2:
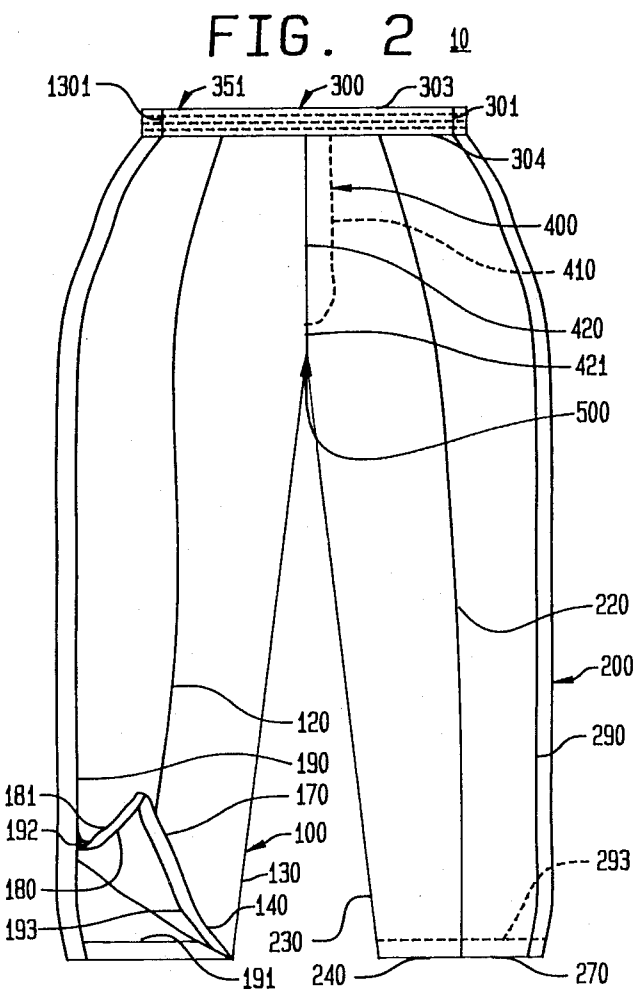
FIG. 2 is a front view of same showing the right leg partially unjoined at the bottom.

FIG. 2 is a front view of pants 10 showing the right leg partially unjoined at the bottom and further showing: right leg 100 including crease 120, seam 130, edge 140, lateral anterior lower horizontal outer edge 170, lateral anterior outer vertical edge 190, lateral rear vertical edge 181, lateral anterior inner vertical edge 180, vertical releasable fastening means 192, anterior inner upper horizontal edge 193, and rear inner upper horizontal edge 191; left leg 200 including medial vertical seam 230, medial anterior lower horizontal edge 240, edge 270, anterior inner upper horizotnal edge 293, edge 290, and crease 220; fly area 400 including edge 420, seam 421, and edge 410; elastic waist band 300 including front waist band portion 351, outer right lateral vertical edge 1301 being a continuation of edge 190, edge 301, edge 303, and edge 304; and showing crotch area 500. Outer fastening means 192 runs along the vertical external strip defined by edges 180 and 181.

Figure 3:
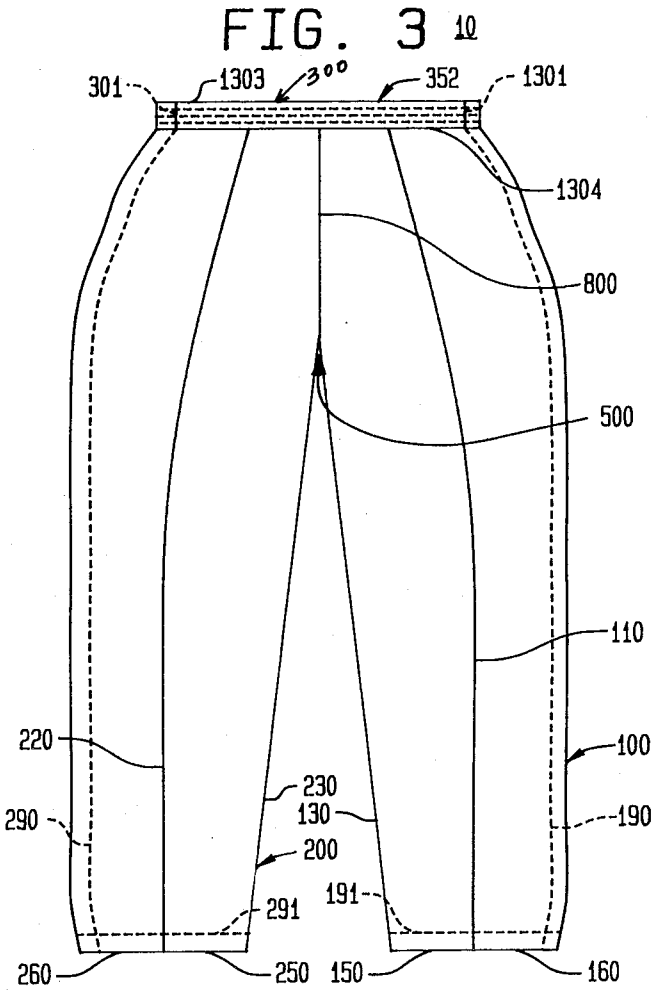
FIG. 3 is a rear view of same.

FIG. 3 is a rear view of pants 10 in the joined configuration showing: right leg 100 including edge 150, upper inner horizontal edge 191, lateral posterior lower horizontal edge 160, lateral anterior outer vertical edge 190, seam 130, and crease 110; left leg 200 including crease 220, edge 290, edge 260, rear upper horizontal inner edge 291, medial rear lower horizontal outer edge 250, and seam 230; elastic waist band 300 including rear waist band portion 352, edge 301, edge 1301, edge 1303, and edge 1304; and showing crotch area 500. Vertical seam 800 runs above crotch area 500 to rear elastic waist band portion 352.

Figure 4:
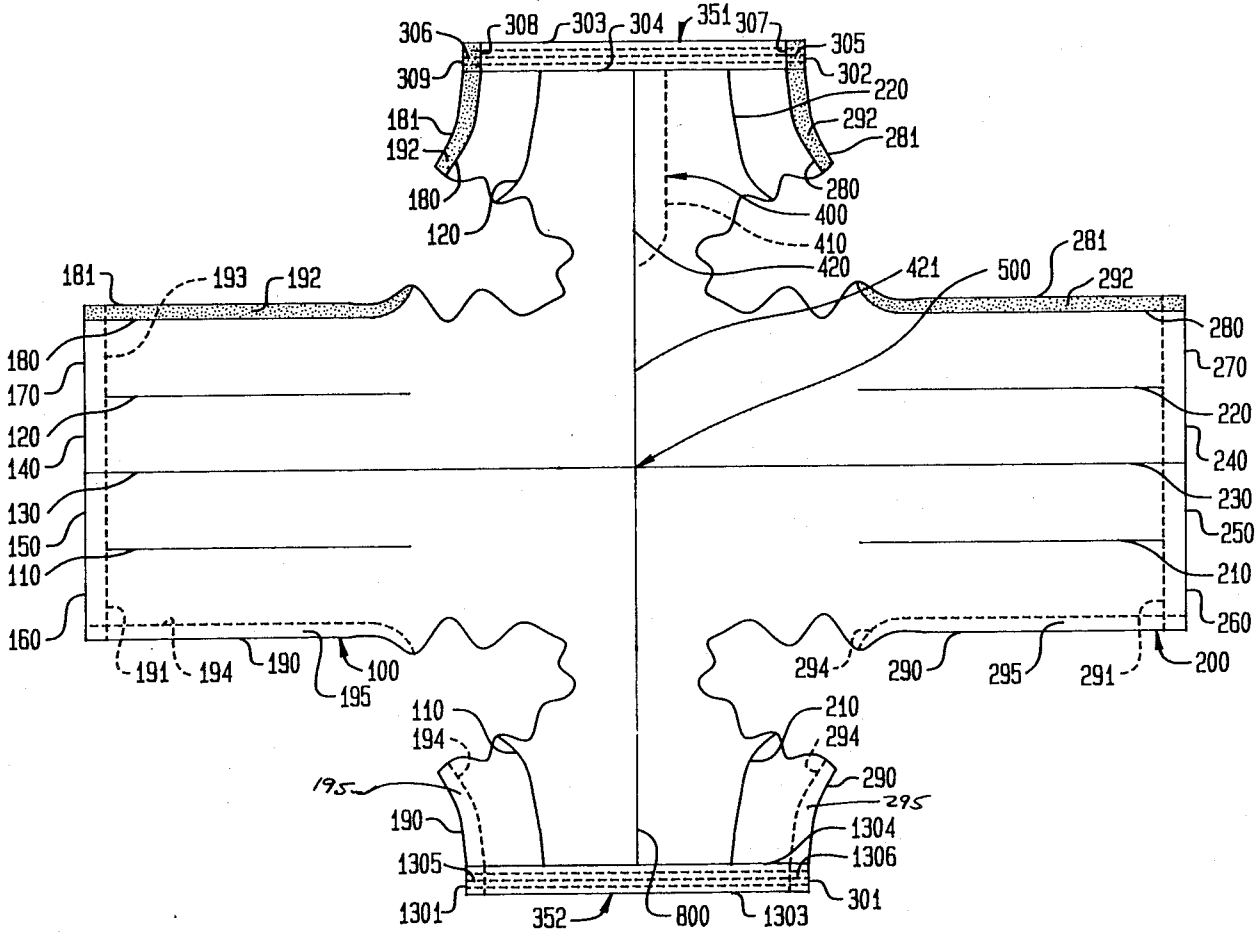
FIG. 4 is a bottom view of same in the unjoined configuration.

FIG. 4 is a bottom view of pants 10 in the unjoined configuration showing: right leg 100 including crease 120, edge 180, releasable fastening means 192, edge 181, edge 170, edge 193, edge 140, edge 150, edge 160, edge 191, edge 194, seam 130, edge 190, crease 110, and releasable fastening means 195; left leg 200 including edge 281, releasable fastening means 292, edge 280, crease 220, edge 270, edge 240, edge 250, edge 260, edge 291, seam 230, edge 290, crease 210, edge 294, and releasable fastening means 295; the upper front waist portion including front waist band portion 351, edge 180, releasable fastening means 192, edge 181, crease 120, edge 309, releasable fastening means 306, edge 308, edge 303, edge 304, releasable fastening means 305, edge 307, edge 302, crease 220, edge 280, releasable fastening means 292, edge 281, edge 420, and seam 421; the upper rear waist portion including rear waist band portion 352, edge 190, edge 194, crease 110, edge 1301, seam 800, edge 1303, edge 1304, edge 301, crease 210, edge 294, and edge 290; and showing crotch area 500 being defined by the intersection of seams 130, 230, 421, and 800. Right outer vertical releasable fastening means 192 and 306 are adapted to be overlapped and fastened onto right inner vertical fastening means 195 and 1305 while left outer vertical releasable fastening means 292 and 305 are adapted to be overlapped and fastened onto left inner releasable fastening means 295 and 1306. Front and rear waist band sections 351 and 352 are rectangular in shape and are made of stretchable elastic material and attach to each other at releasable fastening means 306 and 1305 and at 305 and 1306 respectively to accommodate the waistlines of the patients. Releasable fastening means 306 and 192; 1305 and 195; 305 and 292; and 295 and 1306 respectively are adapted to overlap each other as shown to provide a closed or joined configuration along the lenghts thereof. Pants 10 are made of four similar panels which are defined by: seam 130, seam 421, and edge 420; seam 230, seam 421, and edge 420; seam 130 and seam 800; and seam 230 and seam 800.

While the arrangement according to the present invention has been described in terms of a specific illustrative embodiment thereof, it will be apparent to those skilled in the art that many modifications are possible within the spirit and scope of the disclosed principle.

What is claimed is:

1. A garment comprising:

a right front panel and a left front panel;

a right rear panel and a left rear panel;

a front elastic waistband joining said right and left front panels colinearly along the top portions thereof; and a rear elastic waistband joining said right and left rear panels colinearly along the top portions thereof;

said right and left front and rear panels having a common crotch area and including and being joined at respective common seams emanating from said common crotch area;

wherein each panel further comprises:

a leg portion;

a first straight edge running vertically downward from said common crotch area to the lower medial side of said leg portion;

a second straight edge running horizontally and laterally from said lower medial side to the lower lateral side of said leg portion;

a third straight edge including fastening means running vertically upward from said lower lateral side to the lateral side of the respective waistband;

a fourth straight edge running horizontally and medially from said respective waistband lateral side to the center of said respective waistband;

a fifth straight edge running vertically downward from said respective waistband center to said common crotch area; and wherein: respective first straight edges are permanently joined to form common vertical medial seams of said leg portions;

respective fifth straight edges are permanently joined to form common vertical central seams from said respective waistband to said common crotch area;

respective third straight edges including said fastening means are temporarily joined in an overlapping manner to form common vertical lateral seams of said leg portions;

respective fourth straight edges are permanently joined colinearly along said respective waistband to form the top portion of said garment;

respective unjoined front and rear second straight edges define the bottom opening of said leg portion; and respective unjoined front and rear fourth straight edges define the top opening of said garment.

2. The garment of claim 1 wherein: respective front fifth straight edges are only partially joined to define an open fly area.

3. The garment of claim 1 wherein: the joined right and left front panels include said fastening means on the anterior aspects of their respective front third straight edges and the joined right and left rear panels include said fastening means on the posterior aspects of their respective rear third straight edges to allow for the temporary joining of said fastening means in overlapping manner.

* * * * *